United States Patent [19]

Betsill et al.

[11] 4,011,499

[45] Mar. 8, 1977

[54] LOW LOSS A.C. VOLTAGE REGULATOR

[75] Inventors: Harry E. Betsill; Charles J. Levin; Guilfred L. Vogt, all of Baltimore, Md.

[73] Assignee: The Bendix Corporation, Southfield, Mich.

[22] Filed: Feb. 11, 1976

[21] Appl. No.: 657,339

[52] U.S. Cl. ..... 323/43.5 S; 323/62; 336/150; 361/2

[51] Int. Cl.[2] ..... G05F 1/16

[58] Field of Search ..... 323/43.5 R, 43.5 S, 323/62, 91; 307/133; 336/116, 145, 150

[56] References Cited

UNITED STATES PATENTS

| | | | |
|---|---|---|---|
| 3,195,038 | 7/1965 | Fry | 323/43.5 S |
| 3,818,321 | 6/1974 | Willner et al. | 323/43.5 S |
| 3,970,918 | 7/1976 | Cooper | 323/43.5 S |

FOREIGN PATENTS OR APPLICATIONS

| | | | |
|---|---|---|---|
| 1,393,686 | 5/1975 | United Kingdom | 323/43.5 R |

*Primary Examiner*—Gerald Goldberg
*Attorney, Agent, or Firm*—W. G. Christoforo; Bruce L. Lamb

[57] ABSTRACT

A high speed a.c. voltage regulator comprises a transformer having a plurality of switchable primary windings across which an unregulated voltage is impressed and which control the regulated voltage, and a secondary winding across which the regulated voltage is generated. During a regulation period, which comprises one cycle of the unregulated voltage frequency, peak unregulated input voltage is compared against an upward ramping reference voltage to control a source of clock pulses, where the instantaneous level of the reference voltage is related to the number of clock pulses generated during a regulation period. The number of clock pulses generated during a regulation period controls the switchable windings.

6 Claims, 3 Drawing Figures

LOW LOSS A.C. VOLTAGE REGULATOR

BACKGROUND OF THE INVENTION

This invention relates to voltage regulators and particularly to high speed a.c. voltage regulators in which the output, regulated voltage responds almost instantly to changes in the input, unregulated voltage.

One problem of certain prior art voltage regulators is that they are relatively slow in response to changes in the unregulated input voltage. The present invention provides a rapid acting a.c. voltage regulator by selecting the proper primary windings of a voltage regulator transformer having a plurality of primary windings once during each voltage cycle to maintain a regulated voltage output. The primary windings are selected by obtaining a binary number which is related, in the embodiment to be described, to the positive peak of the unregulated voltage. The binary number obtained is used during the subsequent negative zero crossing to select the proper primary windings of the voltage regulator transformer to maintain a constant output voltage. It is thus an object of this invention to provide a high speed a.c. voltage regulator.

The invention may be understood in clearer detail by examining the drawings wherein:

FIG. 1 is a modified block diagram of the preferred embodiment of the invention, and FIGS. 2*a* and 2*b* are graphs drawn to a common time scale which are helpful in understanding the operation of the invention.

DESCRIPTION OF THE PREFERRED EMBODIMENT

Figure 1:
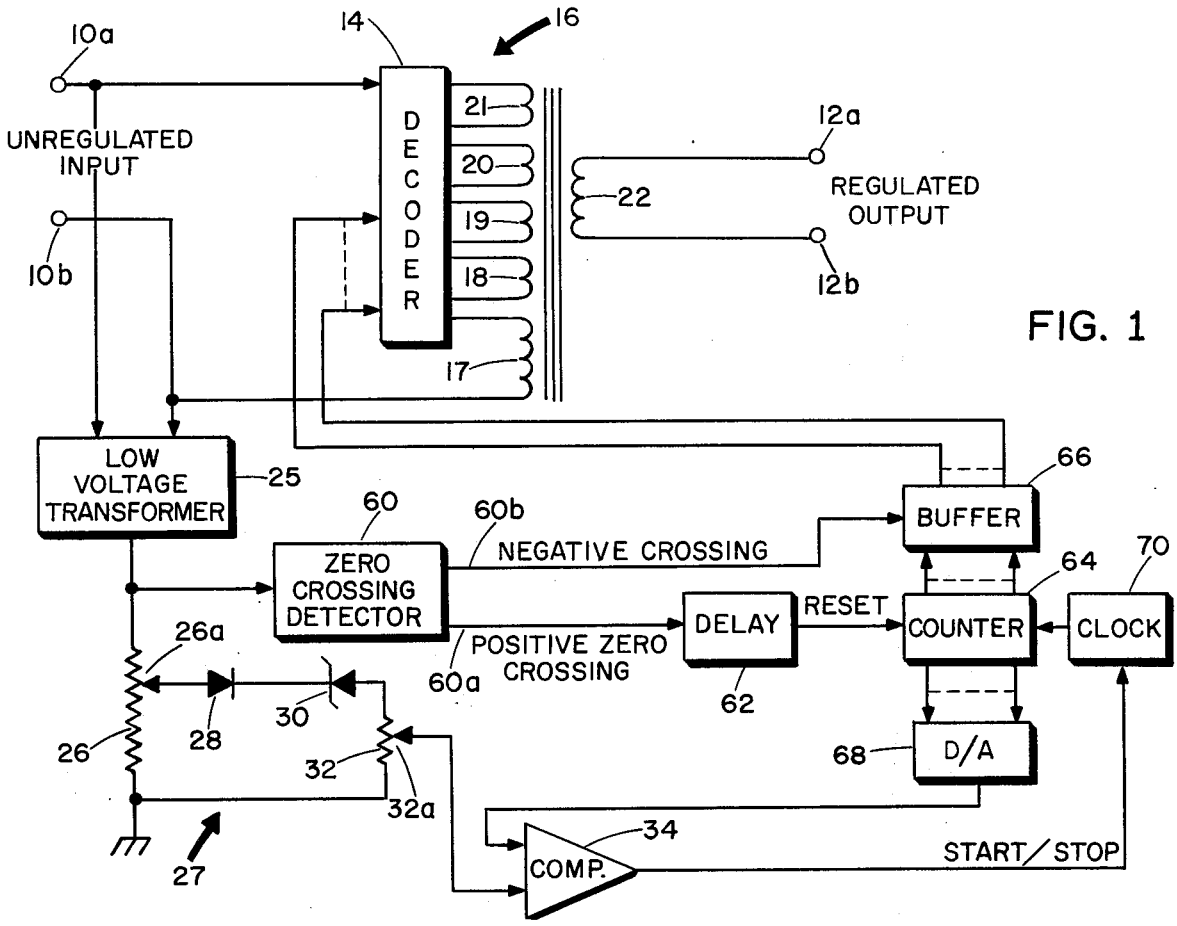

Referring to the figures and particularly to FIG. 1 a modified block diagram of the preferred embodiment of the invention is seen wherein an unregulated input a.c. voltage signal of a known frequency is impressed at input terminals 10*a* and 10*b* and a regulated output a.c. voltage signal is impressed across terminals 12*a* and 12*b*. Terminal 10*a* is connected to a decoder 14, more of which will be mentioned below, while terminal 10*b* is connected to one end of a primary winding 17 of a transformer 16 having a plurality of primary windings 17 to 21 and a secondary winding 22. As will be explained below, decoder 14 selects during each cycle of the voltage signal the proper primary windings to be connected into the circuit across terminals 10*a* and 10*b* to produce a regulated output voltage across terminals 12*a* and 12*b* as the input varies.

Terminals 10*a* and 10*b* are also connected across the primary winding of a low voltage transformer 25 whose secondary winding is connected across a voltage divider 26. Low voltage transformer 25 produces a voltage of a proper magnitude to operate the logic elements, to be described, of the voltage regulator.

A peak tracer 27 is comprised of voltage divider 26 having an adjustable tap 26*a* and a diode 28, Zener diode 30 and voltage divider 32 connected serially between tap 26*a* and the return terminal of transformer 25 secondary winding, here represented as ground. A voltage related to the positive peak of the unregulated input voltage is obtained at tap 32*a* and applied as one input to comparator 34. Adjustable taps 26*a* and 32*a* are provided for initial calibration of the voltage regulator.

Figure 2A:
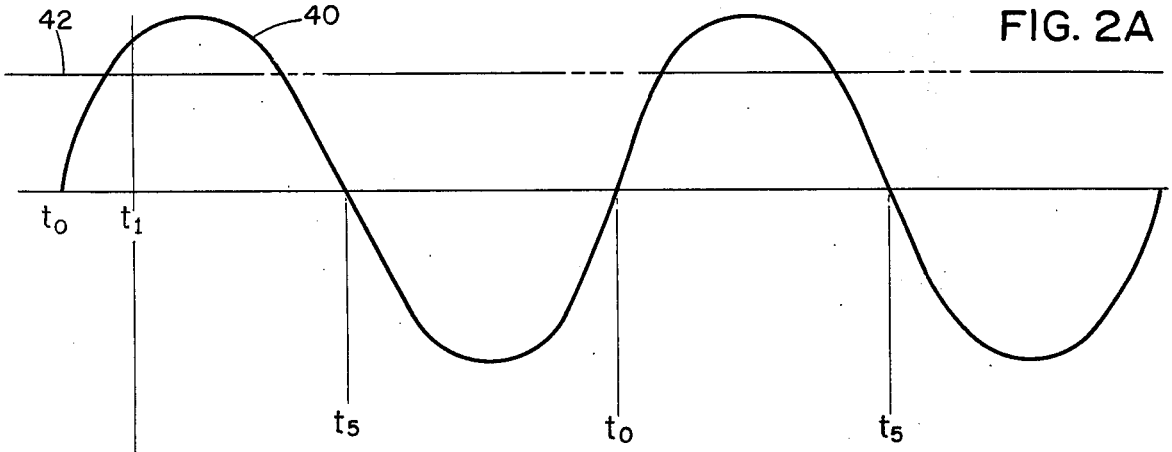
Figure 2B:
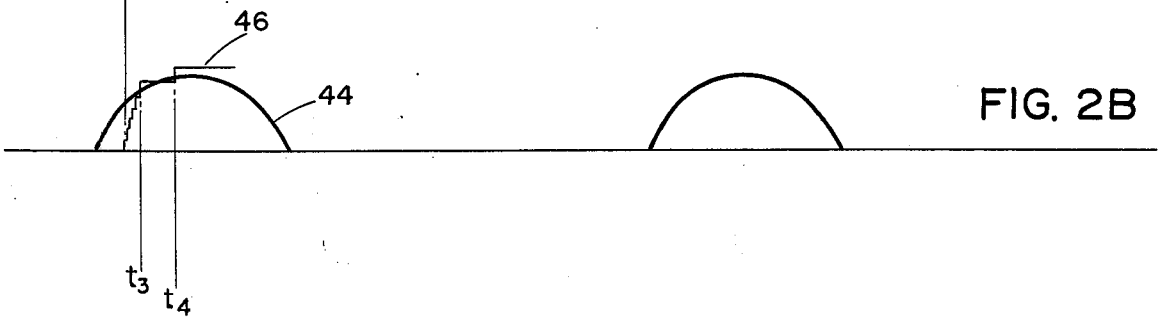

Description of the remaining elements of the regulator, together with an explanation of its operation, can be made clearer by now referring additionally to FIGS. 2*a* and 2*b* wherein curve 40 represents the unregulated input voltage signal and curve 44 represents the voltage at the output of peak tracer 27, that is, the voltage at tap 32*a*.

A regulation period, during which time a binary number related to the positive peak of the unregulated voltage input signal is obtained and the proper primary windings of transformer 16 selected, commences at each positive-going zero crossing of the input signal, for example at time $t_0$. The aforementioned zero crossings are detected by zero crossing detector 60 which receives the output signal from transformer 25 as an input and generates a signal on line 60*a* at each positive-going zero crossing. These positive-going crossings are delayed by delay element 62, suitably a monostable multivibrator, for somewhat less than 90° of the voltage signal and then applied to reset a counter 64 to some initial count, suitably a zero count, at a time, for example, $t_1$. Counter 64 accumulates clock pulses from a clock 70, when energized. The instantaneous count contained in counter 64 is interpreted by a digital-to-analog (D/A) converter 68 to produce a voltage level which is applied as one input to comparator 34. The second input to comparator 34 is obtained from peak tracer 27 and particularly at slider 32*a* of voltage divider 32. The various circuit elements are scaled so that when counter 64 contains a count equivalent to the positive peak voltage of the unregulated input voltage signal comparator 34 generates an output signal which is applied to stop clock 70. However, at the time counter 64 is reset to its initial condition the output from D/A converter 68 will correspond to a voltage level below the instantaneous unregulated input voltage level, thus causing comparator 34 to generate a signal to energize clock 70. Referring particularly to FIG. 2*b*, curve 44, as previously mentioned, represents the voltage signal slider 32*a* of FIG. 1 while curve 46 represents the voltage level signal generated by D/A converter 68, the steps in curve 46 corresponding to the incrementing of counter 64 by clock 70. As previously mentioned, counter 64 starts from some initial value at time $t_1$ and, in this example, at time $t_3$ the count contained in counter 64 is such that the output of D/A converter 68 exceeds the voltage on slider 32*a*, thus causing clock 70 to stop. However, at time $t_4$, since the unregulated input voltage signal has continued to rise, the voltage at slider 32 again exceeds the voltage output of D/A converter 68 so that clock 70 is again turned on until the voltage level of the D/A converter 68 output signal exceeds the voltage level of slider 32*a*. It can thus be seen that during this half cycle of the unregulated input voltage signal counter 64 will eventually accumulate a count which corresponds to the peak of the input signal. This count is suitably temporarily stored in a buffer 66 which can comprise a shift register.

Zero crossing detector 60 also generates an output on line 60*b* upon negative crossings of the unregulated input signal. This signal is generated for example at time $t_5$, and applied to gate the contents of buffer 66, suitably parallel by bit, into a decoder 14 which determines in accordance with the binary number applied thereto which of the primary windings 18 to 21 will be connected in series with winding 17 across terminals 10*a* and 10*b*. At some minimum binary number only winding 17 will be so connected so that the regulated output voltage across terminals 12*a* and 12*b* will be relatively high with respect to the input voltage. As the binary number increases for a particular half cycle additional primary windings are connected into the circuit so as to maintain the output voltage relatively constant.

Because of the binary nature of the signals generated by counter 64 it is desirable for maximum effectiveness of the regulator that windings 18 to 21 be arranged in binary steps, that is so that the contribution of each succeeding winding is double the contribution of the immediately preceding winding. For example, if winding 18 provides a contribution of 2.5 volts then winding 19 would preferably provide a contribution of 5 volts, winding 20 a contribution of 10 volts and winding 21 a contribution of 20 volts.

A four stage counter 64 will adequately control the four windings 18 to 21 in 16 discrete steps. Thus for the scheme shown the regulator will permit an input voltage variation over a range of 35 volts while maintaining the output constant to within at least 1.25 volts. Of course, the number of programmable windings 18 to 21 might be increased or decreased to thereby increase or decrease, respectively, the allowable input voltage variation or to decrease or increase, respectively, the granularity of the output voltage variation.

If known solid state relays are used within decoder 14 for accepting a binary number directly from counter 64, the current/voltage latching characteristics of such relays can be taken advantage of to eliminate the need for a buffer 66 and the necessity that zero crossing detector 60 generate a signal at negative-going zero crossings. As known to those skilled in the art solid state relays of the type described above turn on at zero voltage and off at zero current. Thus, at zero voltage, such as negative-going crossings of the voltage signal the solid state relays will turn on and automatically permit the binary number applied thereto from counter 64 to be decoded to set the proper ones of programmable windings 18 to 21 into the circuit with winding 17.

Having described the preferred structure of this invention and the operation thereof, it should now be obvious to one skilled in the art that certain modifications and alterations may be made therein while still practicing the spirit of the invention. For example, in addition to the embodiment of the invention illustrated at FIG. 1, this invention also contemplates the use of a programmed transformer wherein a single primary winding is connected across input terminals 10*a* and 10*b* and programmable secondary windings are connected in accordance with the number from counter 64 across the output terminals 12*a* and 12*b*. Whereas in the embodiment described with respect to FIG. 1 additional windings are added in series with fixed winding 17 as the peak voltage level of the unregulated input signal increases in order to maintain the output voltage level relatively constant, in the modification described in this paragraph wherein the programmable windings are provided in the secondary of the programmable transformer, secondary windings will be removed from this circuit as the input voltage level increases in order to maintain the output voltage level relatively constant. Other modifications and alterations of the invention will also suggest themselves to one skilled in the art. Accordingly, the invention is to be limited only by the true scope and spirit of the appended claims.

The invention claimed is:

1. A voltage regulator receiving an unregulated input voltage and providing a regulated output voltage comprising:

a programmable transformer having at least a plurality of first winding means and a second winding means;

a first pair of terminals;

a second pair of terminals, one of said input and output voltages being impressed between said first pair of terminals and the other of said input and output voltages being impressed across said second pair of terminals;

means for detecting zero crossings of said input voltage;

a source of clock pulses;

means for counting clock pulses applied thereto;

a digital-to-analog converter for generating a voltage level correlated to the count in said means for counting, said count being correlated to a number;

means comparing said voltage level with the instantaneous level of said input voltage to apply clock pulses from said source to said means for counting, said means for counting being reset to an initial count upon a first zero crossing of said input voltage; and, means responsive to said number for selectively connecting various of said first winding means between one of said first and second pairs of terminals, the winding means so connected being selected in accordance with said number, said second winding means being connected between the other pair of terminals.

2. The voltage regulator of claim 1 wherein said means for selectively connecting responds to said number once in each cycle of said input voltage.

3. The voltage regulator of claim 2 wherein said means for selectively connecting responds to said number in response to a zero crossing of said input voltage opposite in sense to said first zero crossing.

4. The voltage regulator of claim 3 wherein said means for selectively connecting comprises a decoder.

5. The voltage regulator of claim 1 wherein the voltage contribution to said output voltage of one of said plurality of first winding means is double the voltage contribution to said output voltage of another of said plurality of first winding means.

6. The voltage regulator of claim 1 wherein said number comprises a binary number.

* * * * *